US005715702A

United States Patent [19]

Strong et al.

[11] Patent Number: 5,715,702

[45] Date of Patent: Feb. 10, 1998

[54] REFRIGERATION SYSTEM

[75] Inventors: John Richard Strong; Gary Walter Luhm, both of Kirkland; Roger Paul Crask, Issaquah, all of Wash.

[73] Assignee: Frigoscandia Equipment AB, Helsingborg, Sweden

[21] Appl. No.: 752,007

[22] Filed: Nov. 15, 1996

[51] Int. Cl.[6] ..... F25D 17/02

[52] U.S. Cl. ..... 62/434; 62/332

[58] Field of Search ..... 62/332, 434, 54.1, 62/533, 534

[56] References Cited

U.S. PATENT DOCUMENTS

| | | | |
|---|---|---|---|
| 3,558,731 | 1/1971 | Young | 62/534 |
| 3,767,724 | 10/1973 | Gouw | 62/534 |
| 3,788,091 | 1/1974 | Miller | 62/332 |
| 3,869,870 | 3/1975 | Kuehner | 62/333 |
| 3,906,742 | 9/1975 | Newton | 62/332 |
| 4,224,801 | 9/1980 | Tyree, Jr. | 62/332 |
| 5,343,715 | 9/1994 | Lang | 62/332 |

FOREIGN PATENT DOCUMENTS 3004114 11/1980 Germany .

*Primary Examiner*—Ronald C. Capossela
*Attorney, Agent, or Firm*—Browdy and Neimark

[57] ABSTRACT

A refrigeration system comprises a mixing tank for a slurry of solid particles in a liquid, said mixing tank having first and second inlets and an outlet. A sublimator has a bottom inlet, a top outlet and several internal paths connecting the inlet and the outlet, said internal paths having no descending parts. A first conduit connects the outlet of the mixing tank to the bottom inlet of the sublimator via a pump, there being no descending parts between the pump and the inlet of the sublimator. A separator has an inlet and top and bottom outlets. A second conduit connects the outlet of the sublimator to the inlet of the separator, the bottom outlet of the separator being connected to the first inlet of the mixing tank. A compressor has an inlet and an outlet, and conduits connect the top outlet of the mixing tank to the inlet of the compressor and the outlet of the compressor to the second inlet of the mixing tank.

23 Claims, 2 Drawing Sheets

REFRIGERATION SYSTEM

BACKGROUND OF THE INVENTION

1. Field of the Invention

The present invention relates to a refrigeration system using a slurry of solid particles in a liquid as a cooling medium. The particles should be substantially immiscible in the liquid and sublimate at the temperatures and pressures used in a sublimator (evaporator) of the refrigeration system.

2. Background of the invention

DE-A-30 04 114 describes a refrigeration system using particles of solid carbon dioxide and terpene as transport liquid. More particularly, liquid carbon dioxide (carbonic acid anhydride) is expanded below the triple point such that it converts to carbon dioxide particles (snow) and vapor. The carbon dioxide particles are mixed with terpene and the resulting slurry is pumped through a sublimator (evaporator) where the carbon dioxide particles are sublimated at least partly, thereby cooling the sublimator (evaporator) which may be used for the cooling of air, e.g. for freezing and storing of food at so low temperatures as from about −60° C. to about −80° C.

The effluent from the evaporator/sublimator containing terpene, carbon dioxide vapor and remaining carbon dioxide particles, is separated such that the carbon dioxide vapor may be sucked into a compressor and converted to liquid state in a condenser. The liquid carbon dioxide may thereafter be returned into the mixing tank for a new cooling cycle.

SUMMARY OF THE INVENTION

A main object of the present invention is to improve the operational reliability of the prior art sublimation system.

An other object of the present invention is to increase the efficiency of such an improved system.

Further objects and advantages of the present invention will be obvious from the following description.

According to the invention a refrigeration system is provided which comprises a mixing tank for a slurry of solid, sublimatable particles in a liquid, said mixing tank having first and second inlets and an outlet;

a sublimator having an inlet, an outlet and several internal paths connecting the inlet and the outlet;

a first conduit connecting the outlet of the mixing tank to the inlet of the sublimator for the supply of said slurry of solid particles in a liquid to the sublimator;

a separator having an inlet and top and bottom outlets;

a second conduit connecting the outlet of the sublimator to the inlet of the separator for returning sublimated particles and the slurry of still solid particles in the liquid from the sublimator to the separator, the bottom outlet of the separator being connected to the first inlet of the mixing tank for returning the slurry of still solid particles in the liquid to the mixing tank, the top outlet of the separator ejecting the sublimated particles;

means connected to the second inlet of the mixing tank to make up the sublimated solid particles ejected from the top outlet of the separator; and further comprising means for continuously agitating the slurry inthemixing tank.

By continuously agitating the slurry in the mixing tank, a primary source of clogging of the solid particles is eliminated.

Although the refrigeration system according to the invention can be driven by gravity, a pump may be inserted into the first conduit for pumping the slurry from the mixing tank to and through the sublimator.

Preferably, the refrigeration system according to the invention also has no descending parts in the conduit leading from the pump to the sublimator and no descending paths within the sublimator, thereby eliminating clogging of the solid particles from the outlet of the pump to the outlet of the sublimator.

In a preferred embodiment, the mixing tank has an inlet connected to a source of a stirring medium which preferably is the slurry itself obtained from the outlet of the pump in the first conduit.

Preferably, the solid particles consist of carbon dioxide and the liquid is d'limonene. This leads to such possible improvements as a smaller freezer, a faster freezing a higher freezing capacity and also a variable capacity based on sublimator temperature. Also, the low temperature of the sublimator/evaporator reduces the frost deposition thereon and lengthens the time interval between defrosting stops of the system.

DESCRIPTION OF THE PREFERRED EMBODIMENT

Figure 1:
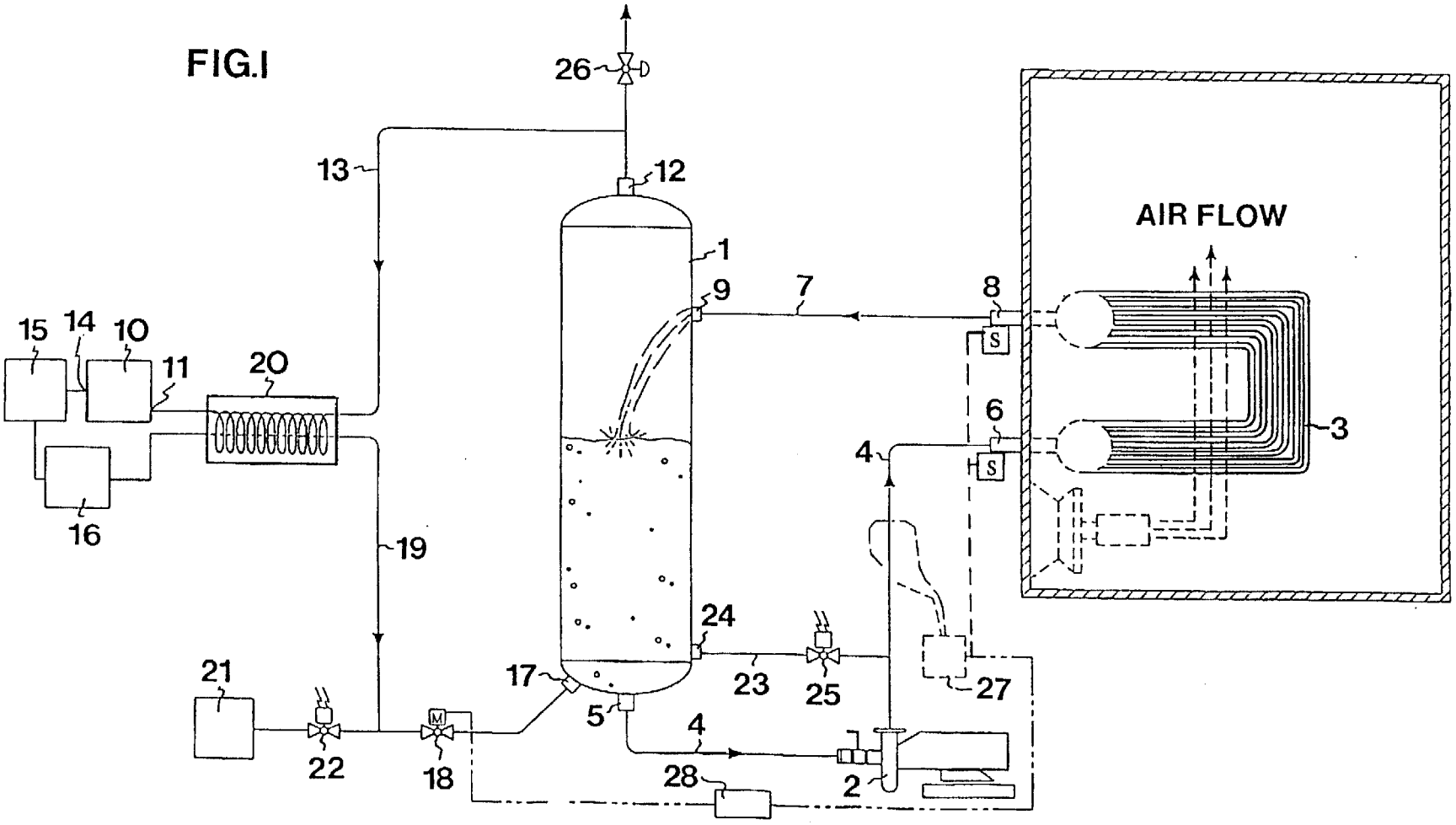
FIG. 1 illustrates schematically a preferred embodiment of a refrigeration system according to the present invention.

In the system shown in the drawings, carbon dioxide is used as cooling medium in combination with d'limonene as transport medium. However, it should be noted that the invention is not limited to these substances but could as well use other substances with corresponding properties, i.e. a first constituent being immiscible in a second liquid constituent and being capable of sublimating at temperatures appropriate for freezing, the second constituent still being liquid at the sublimating temperatures of the first constituent.

Referring to FIG. 1, a refrigeration system according to the invention comprises a mixing and separating tank 1, a pump 2, a sublimator/evaporator coil 3, a conduit 4 connecting a bottom outlet 5 of the mixing and separating tank 1 with an inlet 6 of the evaporator coil via an inlet and an outlet of the pump 2, and a conduit 7 connecting an outlet 8 of the sublimator/evaporator coil 3 with an inlet 9 of the mixing and separating tank 1.

A compressor 10 has an inlet 11 connected to a top outlet 12 of the mixing and separating tank 1 by means of a conduit 13 and an outlet 14 connected to a condenser 15 followed by a receiver 16 which in its turn is connected to a bottom inlet 17 of the mixing and separating tank 1 via a valve 18 and by means of a conduit 19.

A heat exchanger 20 is inserted in the conduits 13 and 19 such that carbon dioxide vapor flowing through the conduit 13 is heated by the liquid carbon dioxide flowing through the conduit 19. As a consequence of this superheating of the carbon dioxide vapor, the cost of the compressor 10 may be reduced substantially.

A supply tank 21 is optionally provided for additional supply of liquid carbon dioxide on demand via a valve 22 into the conduit 19 and through the valve 18 to the bottom inlet 17 of the mixing and separating tank 1. Preferably, the supply of liquid carbon dioxide from the supply tank 21 only takes place when the the demand of liquid carbon dioxide is above the capacity of the compressor, i.e for top loads on the sublimator/evaporator 3.

A conduit 23 connects the outlet of the pump 2 with a bottom inlet 24 of the mixing and separating tank 1 via a valve 25.

The refrigeration system described operates as follows. The mixing and separating tank 1 contains a slurry of solid carbon dioxide particles in a liquid of d'limonene. The pump 2 sucks this slurry from the tank 1 via the bottom outlet 5 thereof such that the slurry is forced through the conduit 4 to the inlet 6 of the sublimator/evaporator coil 3, through this coil 3 to its outlet 8 and via the conduit 7 back to the inlet 9 of the mixing and separating tank 1.

A fan blows air through the evaporator coil 3 such that the solid carbon dioxide particles entrained by the d'limonene transport fluid sublimate to carbon dioxide vapor during the passage through the sublimator/evaporator coil 3. According to the invention, the concentration of solid carbon dioxide in the refrigerant, i.e. the slurry of carbon dioxide particles in the d'limonene transport liquid, entering the evaporator coil 3 should be so high that an excess amount of solid carbon dioxide particles still is present in the effluent from the outlet 8 of the sublimator/evaporator coil 3. This excess of solid carbon dioxide particles ensures an efficient cooling of the whole internal area of the sublimator/evaporator coil 3.

By making the paths of the refrigerant from the pump 2 to and through the evaporator ascending or at least horisontal, i.e. not descending, according to the present invention, the risk of clogging of the solid carbon dioxide particles is completely eliminated. Thus, the flow of the slurry should always be upward or at least level from the pump 1 to and through the sublimator/evaporator 3.

Further, the risk of accumulation of the solid carbon dioxide particles at the bottom of the mixing and separating tank 1 is eliminated by the continuous agitation produced by that part of the slurry which is fed back to the bottom inlet 24 of the mixing and separating tank 1 by the pump 2 via the conduit 23 and the valve 25.

It should be understood, that the agitation could be realized by other stirring media as well as by other means, such as mechanical means.

The refrigerant returning into the mixing and separating tank 1 from the sublimator/evaporator coil 3 via the conduit 7 and the inlet 9 consists of liquid d'limonene, solid carbon dioxide particles and carbon dioxide vapor. Preferably, the inlet 9 is positioned above the surface of the slurry in the mixing and separating tank 1 and directed tangentially such that the carbon dioxide vapor follows an upwardly directed path towards the top otlet 12 of the mixing and separating tank 1, while the d'limonene liquid and the solid carbon dioxide particles are injected into the slurry in the same tank 1.

The compressor 10 sucks the substantially dry carbon dioxide vapor into its inlet 11 via the conduit 13 from the top outlet 12 of the mixing and separating tank 1, the carbon dioxide vapor being superheated in the heat exchanger 20, i.e. to a temperature of at leat −50° C., in order to enable the compressor 10 to operate safely for a reasonable time. Also, this superheating makes it possible to use a compressor of less sophisticated design and thus of less cost. The liquid carbon dioxide fed from the receiver 16 via the conduit 19 and the valve 18 through the inlet 17 could be used as a heating medium in the heat exchanger 20. Alternatively, ammonia used in a prestage for cooling the condenser 15 may be used as the heating medium in the heat exchanger 20.

The inlet 17 of the mixing and separating tank 1 is preferably a bottom inlet in order that the liquid carbon dioxide when injected therethrough and transformed into solid carbon dioxide and carbon dioxide vapor should act as a vigorous stirring medium in the slurry of solid carbon dioxide particles in liquid d'limonene. However, since the injection of liquid carbon dioxide may be discontinuous, that injection might take place at another position and the stirring effect thereof replaced by another stirring mechanism, such as described above. It should be noted that a substantial part of the liquid carbon dioxide is transformed into flash gas when introduced into the mixing and separating tank 1. This flash gas raises the pressure at the outlet 12 of the mixing and separating tank 1. In order not to overload the compressor 10, a valve 26 may be connected to the outlet 12 so as to vent carbon dioxide vapor from the mixing and separating tank 1 to the atmosphere when the pressure thereof exceeds a predetermined limit value.

Further, the momentary value of the vapor pressure inside the mixing and separating tank 1 could be used for regulating the valve 18 such that the pressure does not exceed the predetermined limit. Thus, the value of the pressure within the mixing and separating tank 1 could be used as input value to a PID regulator controlling the opening of the valve 18 via an electric motor.

The refrigerant in the mixing and separating tank 1 should have such a carbon dioxide concentration that the refrigerant pumped into the sublimator/evaporator 3 is overfed with carbon dioxide and thereby cools all the internal surfaces of the sublimator efficiently.

The concentration of solid carbon dioxide in the slurry fed into the sublimator/evaporator 3 may be controlled by the use of a light sensing device 27 to genrate a signal indicative of said concentration, e.g. indirectly by representing the turbidity of the slurry, for regulating the valve 18 by means of an appropriate control system 28 and thus the flow rate of liquid carbon dioxide supplied to the mixing tank 1.

Alternatively, the temperature difference and/or the pressure difference between the inlet 6 and the outlet 8 of the sublimator/evaporator 3 may be used as a controlling input to the control system 28 in order to regulate the flow rate of liquid carbon dioxide supplied to the mixing tank 1. This alternative is shown schematically in FIG. 1 by boxes labeled "S" (for temperature or pressure sensor) which are coupled to the system 28.

In FIG. 1, the mixing and separating tank 1 contains the separator as an upper part thereof, the lower part being used for mixing the solid carbon dioxide particles and the liquid brine for the transport of those particles. However, the separating and mixing functions are preferably performed in substantially separate vessels, as illustrated in FIGS. 2–4.

Figure 2:
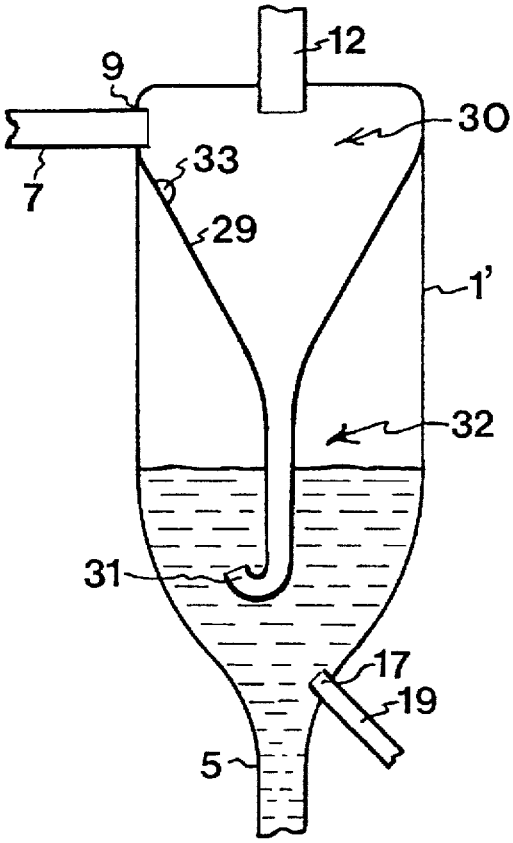
FIGS. 2–4 illustrates alternative embodiments of the separator.

In FIG. 2, a mixing and separating tank 1' has an inner funnel-shaped partition 29 forming the bottom of an upper separating section 30 and having a bottom outlet 31 submerged into the slurry in a lower mixing section 32. More than half of the liquid carbon dioxide introduced through the inlet 17 being vaporized, the partition 29 comprises a tangential vent 33 in order to equalize the pressures in the lower section 32 and the upper section 30. The flash gas thus generated in the lower section 32 passes through the vent 33 having the form of a nozzle such that the vapor is accelerated tangentially within the funnel-shaped upper section 30. Thus, the slurry in the lower section 32 is agitated by the liquid carbon dioxide from the inlet 17 and the resulting carbon dioxide vapor is centrifugally separated from any entrained droplets of brine before returning to the compressor 10 via the top outlet 12.

Figure 3:
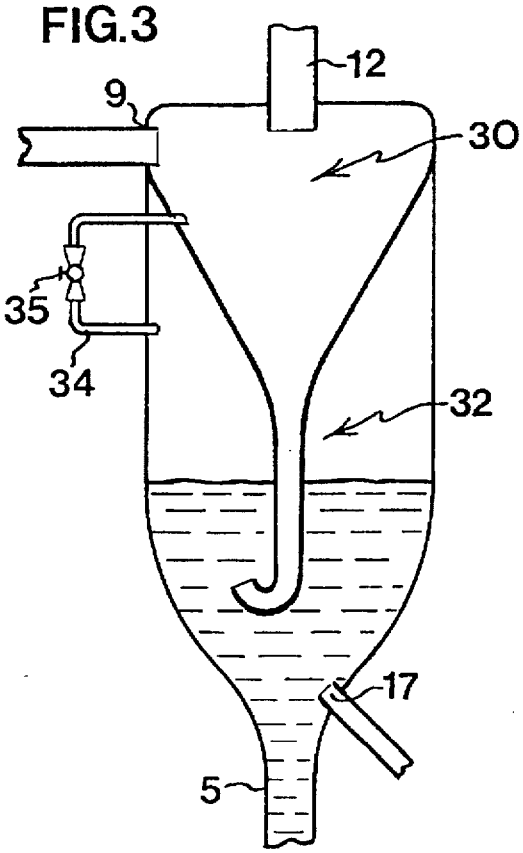

As illustrated in FIG. 3, the direct vent 33 into the upper section 30 can be replaced by a pipe 34 having a pressure regulator 35 such that a predetermined pressure difference may exist between the lower section 32 and the upper section 30 acting to pump the slurry out through the outlet 5 towards the pump 2. Of course, the pressure difference must be lower than the pressure from the column of slurry coming out of the funnel-shaped bottom part of the upper section 30.

Figure 4:
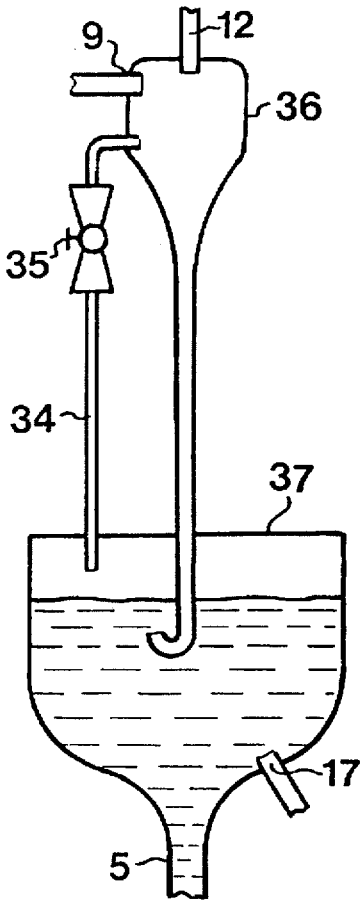

Still another embodiment is illustrated in FIG. 4, wherein a first separate vessel 36 is used for the separation of the refrigerant returned from the sublimator/evaporator 3 via the inlet 9 and a second separat vessel 37 is used for the mixing of the solid carbon dioxide particles and the low temperature brine. In FIG. 4, the pipe 34 and the pressure regulator 35 connect the first and second separate vessels 36 and 37 for the same purpose as in the embodiment shown in FIG. 3.

It is to be understood that modifications, alterations and changes can be made in the refrigeration system without departing from the scope of the invention as claimed herein. Thus, it is intended that the above description and the accompanying drawings shall be interpreted as illustrative and not in a limiting sense.

What we claimed is:

1. A refrigeration system comprising:

a tank having a bottom outlet (5) and a top outlet (12), said tank further comprising an upper separator chamber having therein the top outlet and including a separator inlet (9), and a lower mixing chamber for a slurry of solid, sublimatable particles in a liquid, said mixing chamber having therein the bottom outlet and including a first mixing inlet (17);

a sublimator having a sublimator inlet (6), a sublimator outlet (8), and a plurality of internal paths connecting the sublimator inlet and the sublimator outlet;

a first conduit (4) connecting the bottom outlet (5) to the sublimator inlet (6) for supply of said slurry of solid particles in a liquid to the sublimator;

a second conduit (7) connecting the outlet (8) of the sublimator to the separator inlet (9) for returning gas composed of sublimated particles and the slurry of still solid particles in the liquid from the sublimator to the separator chamber, the top outlet (12) ejecting the gas composed of sublimated particles;

a sublimated solid particle supplier (10, 11, 14–16, 20) connected to the first mixing chamber inlet (17) to make up the sublimated solid particles ejected as gas from the top outlet; and further comprising an agitator (23–25) for continuously agitating the slurry in the mixing chamber.

2. A refrigeration system comprising:

a separator having therein a top outlet (12) and including a separator inlet (9);

a mixing tank for a slurry of solid, sublimatable particles in a liquid, said mixing tank being disposed below the separator and including a bottom outlet (5), a first mixing tank inlet (17), and a second mixing tank inlet (31) disposed in an upper portion thereof and communicating with a lower portion of the separator;

a sublimator (3) having a sublimator inlet (6), a sublimator outlet (8), and a plurality of internal paths connecting the sublimator inlet and the sublimator outlet;

a first conduit (4) connecting the bottom outlet (5) to the sublimator inlet (6) for supply of said slurry of solid particles in a liquid to the sublimator;

a second conduit (7) connecting the outlet (8) of the sublimator to the separator inlet (9) for returning gas composed of sublimated particles and the slurry of still solid particles in the liquid from the sublimator to the separator, the top outlet (12) ejecting the gas composed of sublimated particles;

a sublimated solid particle supplier (10, 11, 14–16, 20) connected to the first mixing chamber inlet (17) to make up the sublimated solid particles ejected as gas from the top outlet; and further comprising an agitator (23–25) for continuously agitating the slurry in the mixing chamber.

3. A refrigeration system as claimed in claim 2, wherein the mixing tank has a further inlet below the level of the slurry and connected to a source of a stirring medium.

4. A refrigeration system as claimed in claim 3, comprising a pump in the first conduit for pumping the slurry from the mixing tank to and through the sublimator, said pump forming said source and having an outlet connected to said further inlet of the mixing tank.

5. A refrigeration system as claimed in claim 4, wherein the first conduit has no descending part between the pump and the inlet of the sublimator.

6. A refrigeration system as claimed in claim 2, wherein the solid particles consist of carbon dioxide and the liquid is a low temperature brine.

7. A refrigeration system as claimed in claim 6, wherein the liquid is d'limonene.

8. A refrigeration system as claimed in claim 6, wherein the flow rate of carbon dioxide into the mixing tank is controlled in response to the difference between the temperature of the slurry at the inlet of the sublimator and the temperature of the slurry at the outlet of the sublimator.

9. A refrigeration system as claimed in claim 8, wherein the flow rate of carbon dioxide into the mixing tank also is controlled in response to the difference between pressure at the inlet of the sublimator and the pressure at the outlet of the sublimator.

10. A refrigeration system as claimed in claim 6, wherein the flow rate of carbon dioxide into the mixing tank is controlled in response to the difference between pressure at the inlet of the sublimator and the pressure at the outlet of the sublimator.

11. A refrigeration system as claimed in claim 6, further comprising a pump in the first conduit for pumping the slurry from the mixing tank to and through the sublimator, and a compressor having an inlet connected to the top outlet of the separator and an outlet connected to the second inlet of the mixing tank.

12. A refrigeration system as claimed in claim 11, further comprising a sensor of the concentration of solid carbon dioxide at the outlet of the pump for controlling the flow rate of liquid carbon dioxide supplied to the mixing tank.

13. A refrigeration system as claimed in claim 2, further comprising a compressor having an inlet connected to the top outlet of the separator and an outlet connected to the second inlet of the mixing tank.

14. A refrigeration system as claimed in claim 2, further comprising a supply tank of liquid carbon dioxide connected to the second inlet of the mixing tank.

15. A refrigeration system as claimed in claim 14, further comprising a valve controlling the flow rate of liquid carbon dioxide from the supply tank in response to a demand of liquid carbon dioxide above the capacity of the compressor.

16. A refrigeration system as claimed in claim 15, further comprising a sensor of the concentration of solid carbon dioxide at the outlet of the pump for controlling the flow rate of liquid carbon dioxide supplied to the mixing tank.

17. A refrigeration system as claimed in claim 2, wherein the slurry contains solid carbon dioxide in excess such that also the effluent from the sublimator contains solid carbon dioxide particles.

18. A refrigeration system as claimed in claim 2, wherein the separator is contained in the mixing tank.

19. A refrigeration system as claimed in claim 18, wherein the bottom outlet of the separator is submerged in the slurry in the mixing tank.

20. A refrigeration system as claimed in claim 19, wherein the separator has a funnel-shaped bottom part.

21. A refrigeration system as claimed in claim 20, wherein the funnel-shaped bottom part forms a partition between the separator and the mixing tank.

22. A refrigeration system as claimed in claim 18, wherein the separator is formed by an upper part of the mixing tank.

23. A refrigeration system as claimed in claim 2, wherein the separator is in gas communication with an upper part of the mixing tank.

* * * * *